US005348175A

United States Patent [19]

Reynard

[11] Patent Number: 5,348,175

[45] Date of Patent: Sep. 20, 1994

[54] LIFT FITTING FOR CARGO CONTAINERS

[76] Inventor: Kenneth Reynard, 13D Croft Heads, Sowerby, Thirsk, N/Yorks Y07 INY, Great Britain

[21] Appl. No.: 802,612

[22] Filed: Dec. 5, 1991

[51] Int. Cl.[5] ..... B65D 33/00

[52] U.S. Cl. ..... 220/1.5

[58] Field of Search ..... 220/1.5

[56] References Cited

U.S. PATENT DOCUMENTS

| | | | |
|---|---|---|---|
| 3,044,656 | 7/1962 | Combs et al. | 220/1.5 X |
| 3,128,897 | 4/1964 | Wilkins | 220/1.5 |
| 3,221,921 | 12/1965 | Silverman | 220/1.5 X |
| 3,386,600 | 6/1968 | Betjemann | 220/1.5 X |
| 3,529,741 | 9/1970 | Walker et al. | 220/1.5 X |
| 4,506,798 | 3/1985 | Goutille | 220/1.5 |
| 4,558,797 | 12/1985 | Mitchell | 220/1.5 X |
| 4,844,672 | 7/1989 | Yurgevich | 220/1.5 X |

*Primary Examiner*—Steven M. Pollard
*Attorney, Agent, or Firm*—Browdy & Neimark

[57] ABSTRACT

A lift fitting casting for long body cargo containers wherein the lift fitting is positioned inboard from the corners of the container, the lift fitting being defined by a hollow body member for receipt of a lifting crane arm, the body member having a stepped depending spigot portion for attachment to a vertical cargo container member in order to maintain the integrity and geometry of the container and eliminate any requirement for internal strengthening members within the cargo container.

9 Claims, 4 Drawing Sheets

LIFT FITTING FOR CARGO CONTAINERS

FIELD OF THE INVENTION

The present invention relates to lift fittings for cargo containers and, in particular, lift fittings positioned inboard from the ends of cargo containers which cargo containers do not conform to international standard lengths.

BACKGROUND OF THE INVENTION

Cargo containers have become the standard means of transportation of material by road, rail and sea. As a result of their universal usage, standards have been established with respect to the size of cargo containers and design of cargo containers so that they can be transported anywhere in the world using uniform lifting points. These uniform lifting points are required in that the cargo containers are most often lifted and moved by vehicular cranes or marine cranes which either load or unload the cargo container on a flatbed truck or railroad car or load or unload ocean-going container vessels.

The established standardized lengths are 10 feet, 20 feet, 30 feet and 40 feet. Containers of these dimensions have their lifting points comprised of lift fittings located in the corners of the containers such that the lift fitting has the benefit of two intersecting walls for support. Each wall would have horizontal support members which would be secured to the lift fitting and a vertical post at the intersection of the walls would be secured to the lift fitting. Thus, the rectangular box-like integrity of the container is maintained by the interconnection of the lift fittings and the horizontal and vertical supports.

Recent developments in the United States, Canada and Mexico have led to the development of domestic containers of nonstandard lengths in order to accommodate high volume payloads and reduce the associated cost of shipping. These nonstandard containers utilized in the domestic market are typically found in lengths of 45 feet, 48 feet or 53 feet. Despite the nonstandard length, these cargo containers still must be lifted with vehicular cranes or marine cranes which are designed to the international standard. Therefore, lifting points must be provided inboard from the ends of these nonstandard containers. These lifting points are fitted into the portal frames, but due to the fact that the frames are not supported by end walls, the necessity arises for supporting the transverse loads imposed during transportation. To overcome this problem, the lifting points and the frames are supported by large triangular gussets which stiffen the frames. However, these gussets make the internal loading of the cargo container difficult and reduce the effective cargo space within the container.

Accordingly, the present invention is directed to a lift fitting for positioning in the portal frame of nonstandard cargo containers which does not require any external stiffening and thus facilitates loading of the cargo container and increasing the effect of cargo space of the container while still maintaining the integrity of the container when being moved.

OBJECTS OF THE INVENTION

An object of the present invention is to provide a novel lift fitting for cargo containers which permit nonstandardized length containers to be lifted by existing cargo cranes.

Another object of the present invention is to provide for a novel lift fitting for cargo containers which maintains the integrity of the cargo container shell during lifting.

A further object of the present invention is to provide for a novel lift fitting for cargo containers which does not require any internal support members within the cargo container to maintain the integrity of the cargo container.

A still further object of the present invention is to provide for a novel lift fitting for cargo containers which allows for increased storage space within the cargo container due to the absence of internal stiffeners.

A still further object of the present invention is to provide for a novel lift fitting for cargo containers which staggers the heat affected zone and stress concentration where the lift fitting is secured to vertical stiffeners.

SUMMARY OF THE INVENTION

A lift fitting for cargo containers which permits the lifting of nonstandardized length cargo containers by existing standardized crane mechanisms, the lift fitting being positioned on the cargo container on opposing lateral edges, inboard from the corners of the cargo container, the lift fitting having a body defining a chamber, the body having an aperture in its upper surface communicating with the chamber to permit the engagement of a lifting element within the chamber, the body having a depending tapered spigot from its lower surface for attachment to a vertical supporting post of the cargo container, the body optionally having positioned within the chamber, stiffening gussets for further support, the body being secured by welds to upper lateral stiffening posts of the cargo container on its lateral side and to the vertical stiffening posts by welds adjacent the spigot.

BRIEF DESCRIPTION OF THE DRAWINGS

These and other objects of the present invention will become apparent when taken in light of the following illustrations which depict the preferred embodiment of the lift fitting wherein.

DETAILED DESCRIPTION OF THE DRAWINGS

Figure 1:
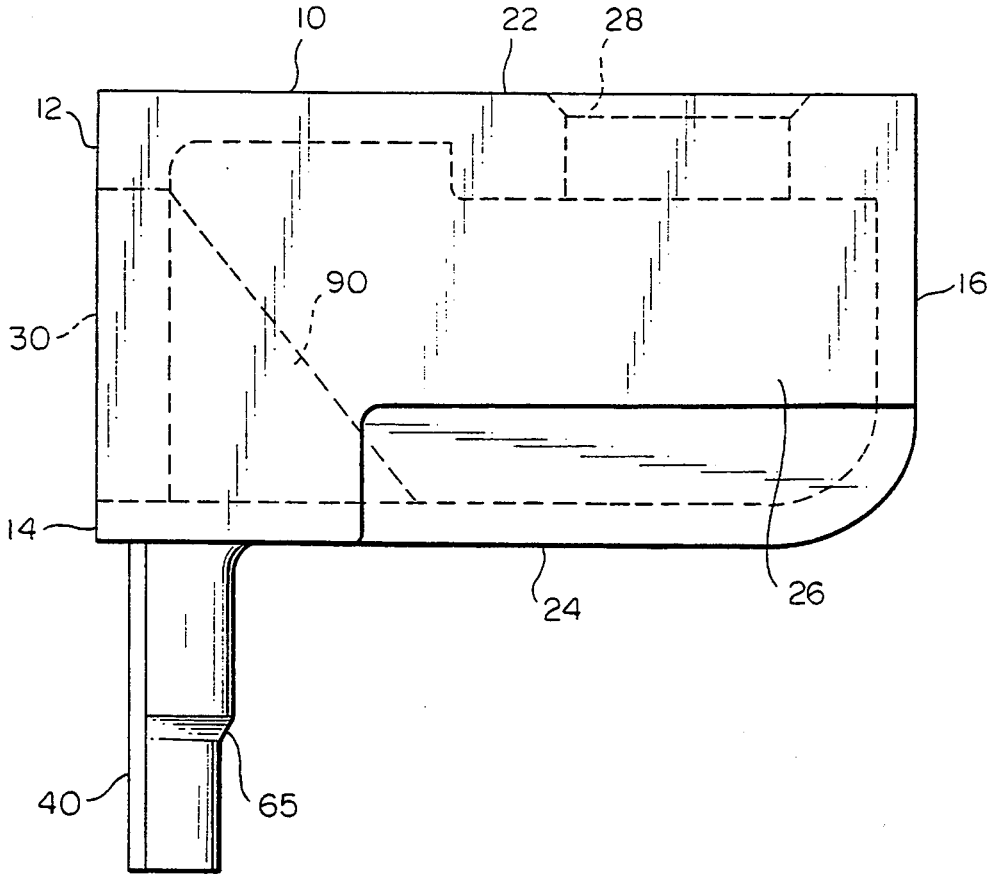
FIG. 1 is a side view of the lift fitting.

Referring to FIG. 1, there is illustrated a side view of a lift fitting 10. Lift fitting 10 is a one-piece cast construction and is generally square or rectangular in shape. Lift fitting 10 consists of a body portion 12 defined by an outer end wall 14, an inner end wall 16, and sidewalls 18 and 20 together with an upper surface 22 and a lower surface 24. Body 12 of lift fitting 10 has a substantially hollow interior chamber 26. An aperture 28 communicates with chamber 26 from upper surface 22. An additional aperture 30 communicates with chamber 26 through outer end wall 14.

Figure 2:
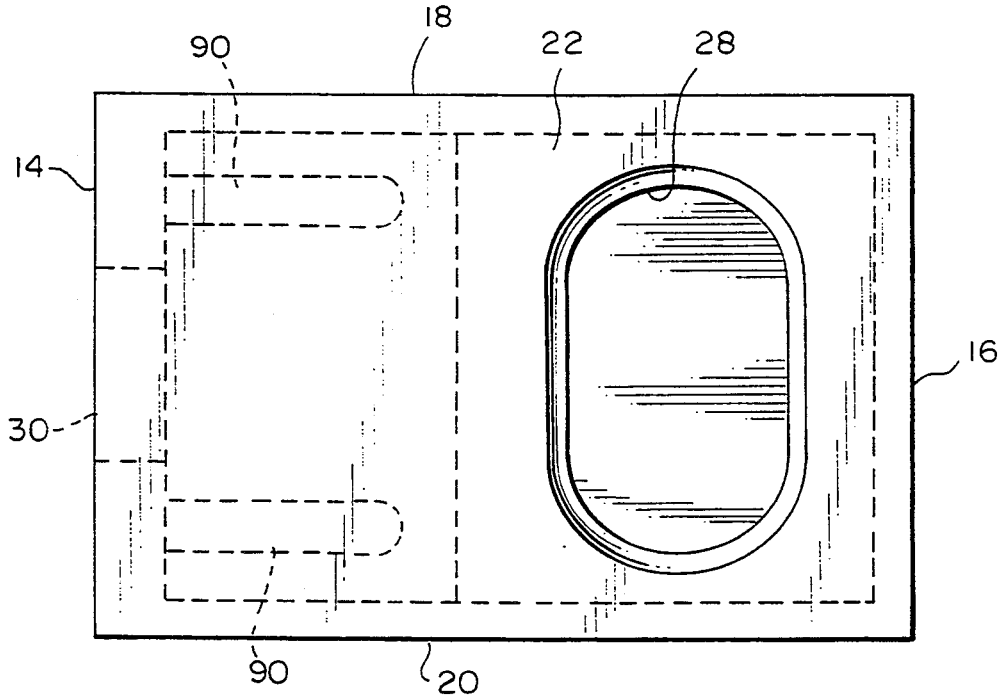
FIG. 2 is a top view of the lift fitting.
Figure 4:
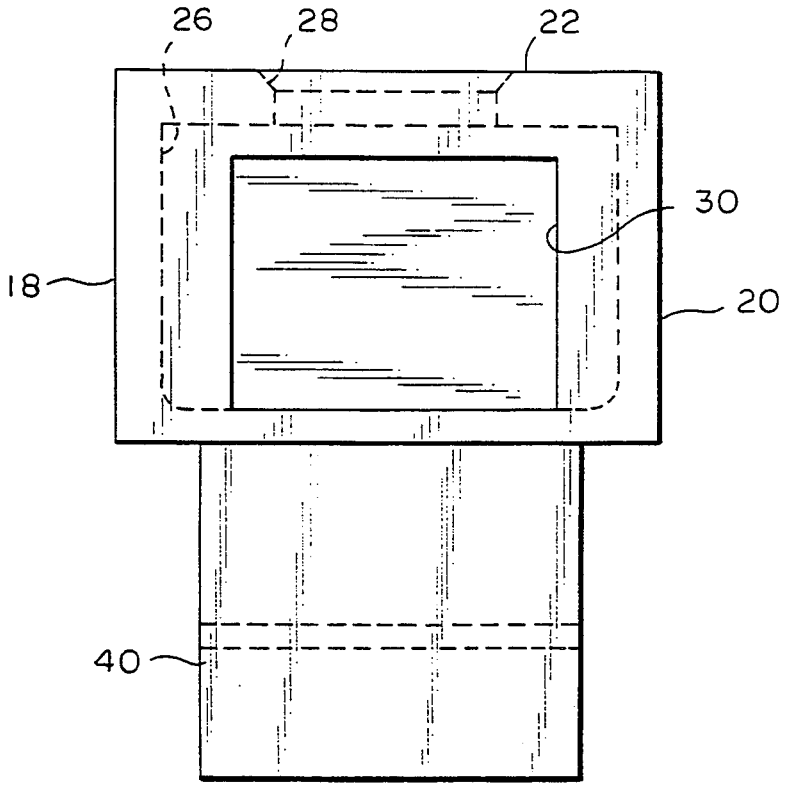
FIG. 4 is a rear view of the lift fitting.

Apertures 28 and 30 may best be viewed with reference to FIG. 2 and 4 which illustrate a top view and rear view, respectively, of lift fitting 10.

The structure thus far disclosed is representative of standard lift fittings used in the industry. In practice, the lift fitting 10 would be positioned in the corner of the cargo container of standardized size. A vehicular or marine crane having four depending lifting arms would position the lifting arms over each of the lift fittings. The lifting arms would be inserted through aperture 28 into chamber 26 simultaneously in all four lift fittings and a swivel finger portion of the lifting arms positioned within chamber 26 would swivel to engage each of the lifting arms with the lift fitting. The cargo container could thus be lifted and positioned in the desired location.

Aperture 30 in outer end wall 14 is normally used to secure adjacent containers when the containers are positioned in a stacked position such as on a cargo vessel.

Applicant's lift fitting differs from the standard lift fittings and has particular application to non-standardized length cargo containers through the development of a depending spigot 40 which depends downwardly from lower surface 24 of lift fitting 10 proximate to outer end wall 14. A better understanding of the cooperation of spigot 40 with lift fitting 10 and the cargo container is schematically-illustrated in FIG. 5 which is a schematic illustration of a cargo container 50. Cargo container 50 is constructed of horizontally-positioned supports or headers 52 secured by a plurality of vertical supports 54 positioned at the corners thereby defining a rectangular box-like structure, the sides, top and bottom being composed of sheet steel with at least one end of the container serving as an access door. If the cargo container 50 were of standardized length, a standard lift fitting 56 would be positioned in each of the upper and lower corners of the container secured to intersecting horizontal and vertical supports 52 and 54, respectively. If cargo container 50 in FIG. 54 were of non-standard lengths it would therefore require the lift fitting 10 of the present invention to be positioned inboard from the corners of the cargo container.

Figure 5:
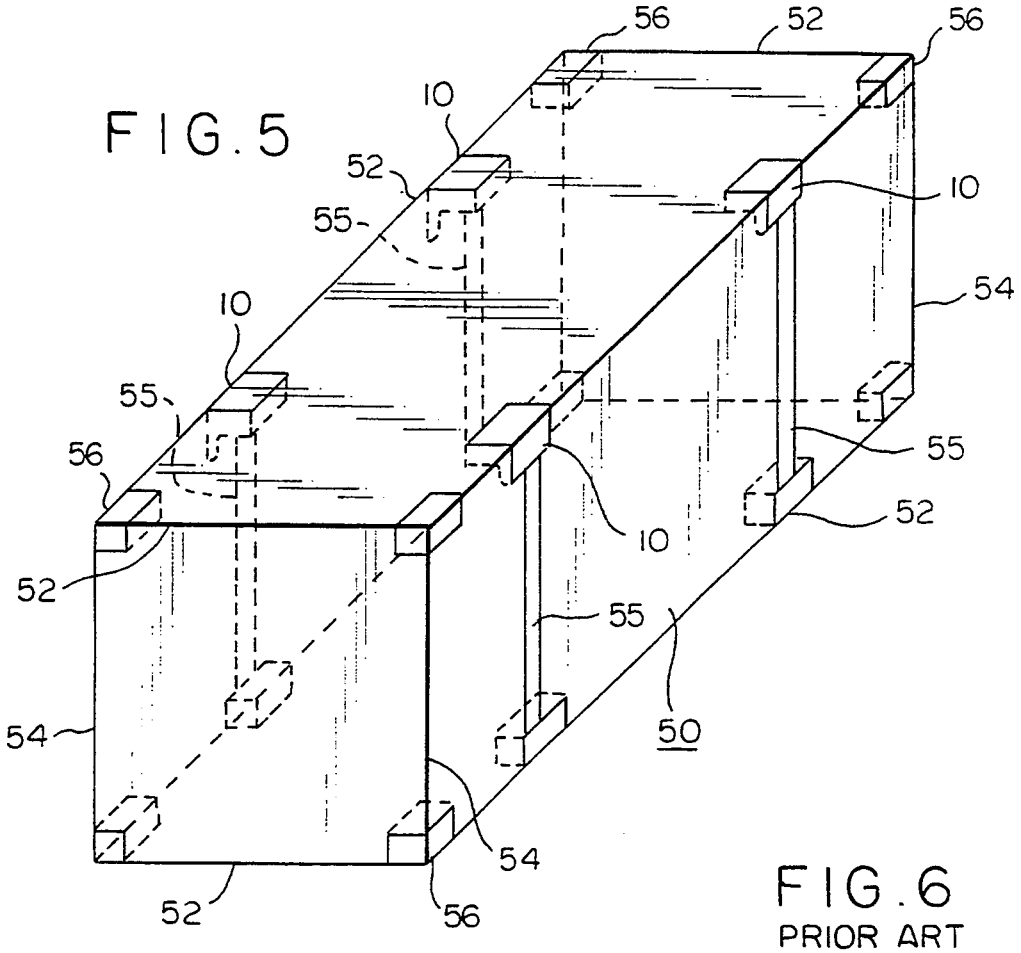
FIG. 5 is a schematic illustration of a cargo container utilizing the lift fitting of the subject invention.

As FIG. 5 schematically illustrates, lift fitting 10 is positioned and secured to horizontal rail 52. Lift fitting 10 is normally secured by welding the fitting directly to railings 52. Depending spigot 40 (not shown in FIG. 5) of lift fitting 10 is then welded to a vertical support bar 55 which extends from depending spigot 40 to an opposing lift fitting positioned in the lower portion of the cargo container 50, this lift fitting being secured by welds to the lower horizontal rails 52 of cargo container 50. Each of the bottom corners of cargo container 50 has positioned therein, a standardized lift fitting in order to provide structural integrity to the cargo container.

In this configuration, lift fitting 10 which is the subject matter of the present invention can be positioned along the upper inboard surface of cargo container 50 at a distance apart which will allow the vehicular or marine cranes which are adapted to standardized containers, to lift and move these nonstandardized containers. To accomplish this with a lift fitting which did not have a depending spigot 40, required additional triangular bracing within the cargo container as illustrated in FIG. 6 and this bracing made it difficult to load the container and also deprived the container's user of certain available storage space in the upper corners of the container.

Figure 6:
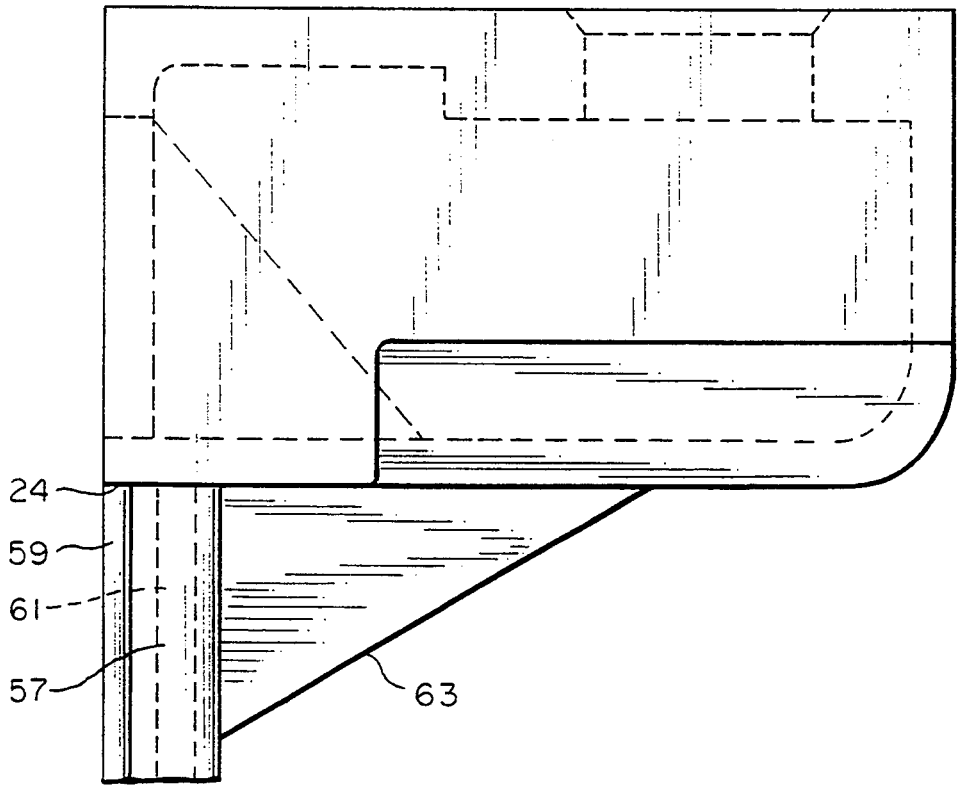
FIG. 6 PRIOR ART
FIG. 6 is a side view of the prior art lift fitting.

FIG. 6, labelled Prior Art, shows the manner in which an existing standard lift fitting would be secured to a two-piece vertical support comprised of an inner post 57 and an outer post 59. Inner post 57 would have an internal stiffener post 61. The combination of these three elements would be secured by welding to lower surface 24 of the standard lift fitting, proximate to outer end wall 14. In such a configuration, all loads in the container would be transmitted through this particular welding point. This was not suitable to the integrity of the container when the lift fitting was positioned inboard from the corners of the container such as would be the case with a non-standardized length cargo container. Therefore, the necessity of an internal gusset 63 positioned within the container, gusset 63 being secured to lower surface 24 of the lift fitting and to inner post 57 of the vertical support. It is this gusset which limited the available storage space within the cargo container in order to provide additional stiffening for the lift fitting and the vertical support.

The depending spigot 40 on lift fitting 10 eliminates the need for gusset 63 or any other bracing within the container. Depending spigot 40 is stepped downwardly from its connection with body 12 which allows depending spigot 40 to be secured to a vertical support post which comprises an inner post and an outer post and a stiffener and which allows spigot 40 to be secured to vertical support post 55 by a means such as welding such that no damage to lift fitting 10 occurs during the securing process and the securing of spigot 40 to vertical support post 55 results in a structure which allocates the stresses incurred in moving the container throughout vertical support bar 55 and thus alleviates the problem of all loads being transmitted through a single weld between vertical support post 55 and body 12 as illustrated in FIG. 6.

Figure 3:
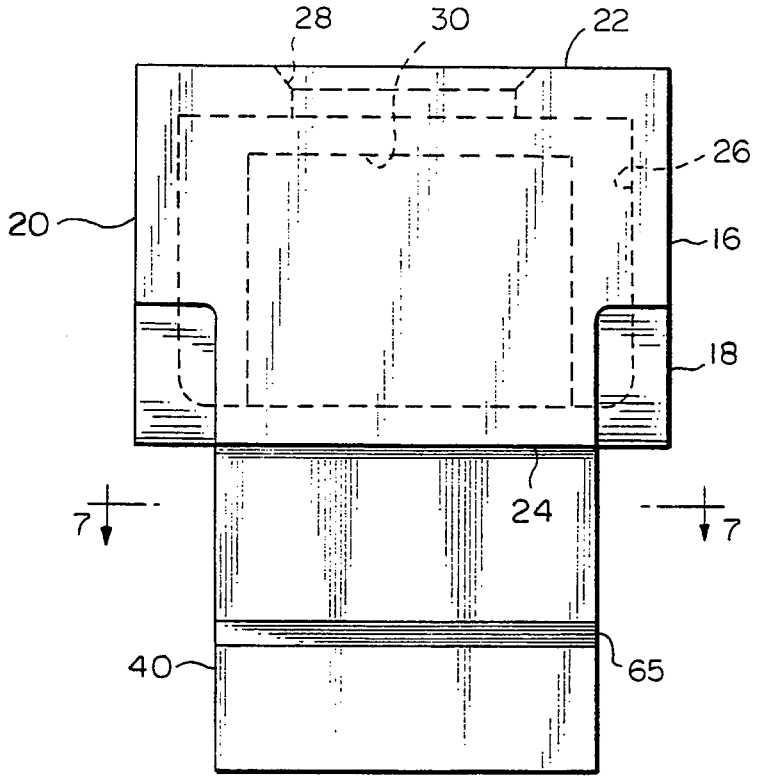
FIG. 3 is a front view of the lift fitting.
Figure 7:
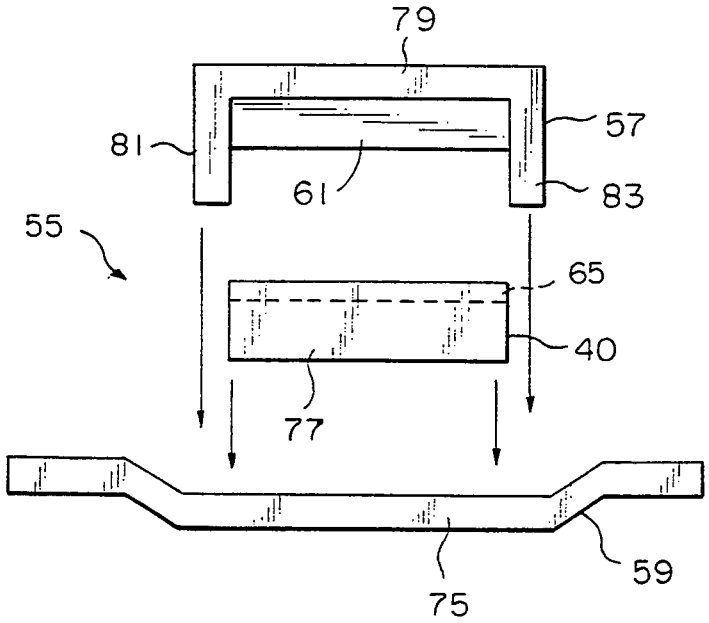
FIG. 7 is a top exploded view along plane 7—7 of FIG. 3.
Figure 8:
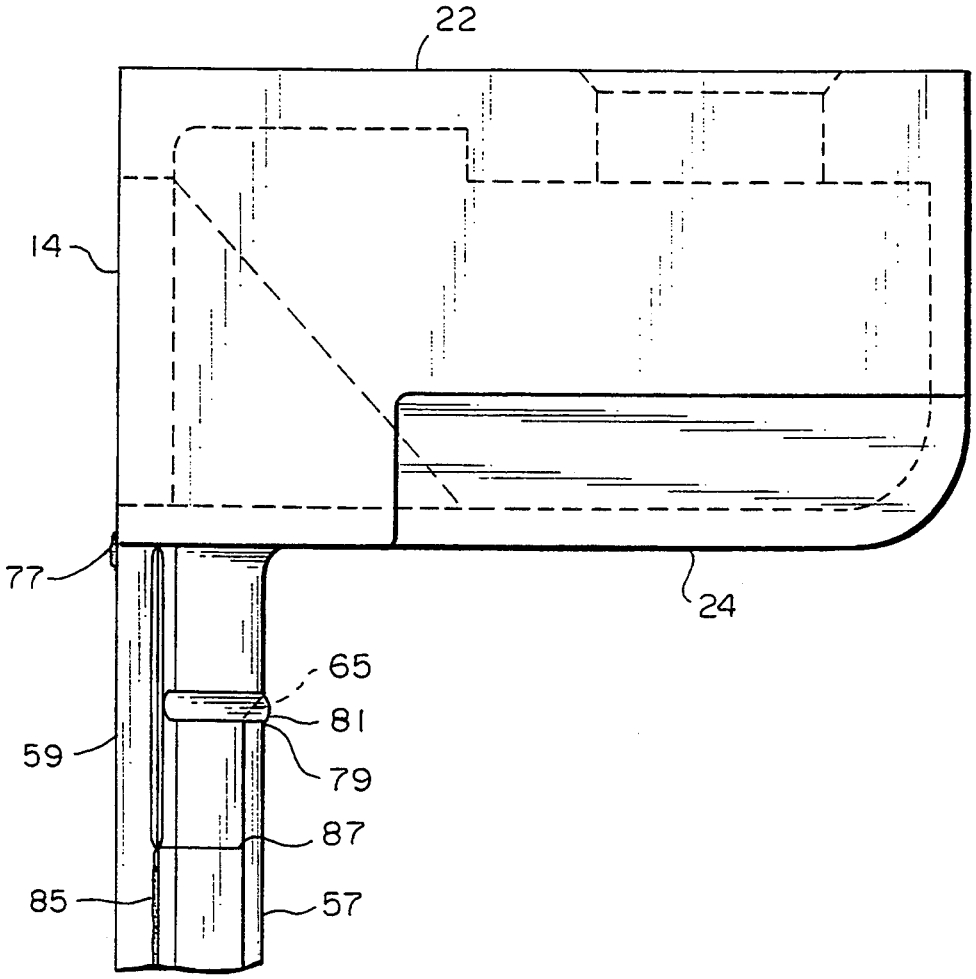
FIG. 8 is a side view illustrating the lift fitting secured to a vertical support post.

A better understanding of the relationship and cooperation of downwardly-depending spigot 40 and vertical support post 55 can be had by reference to FIG. 7 which is a top planer exploded view of depending spigot 40 along plane 7—7 of FIG. 3. Downwardly-depending spigot 40 is stepped or tapered on its interior facing surface having a beveled surface 65 (see FIG. 1). Vertical support post 55 as illustrated in FIG. 7 is comprised of three elements, an outer post 59, an inner post 57 and a stiffener post 61. The container stress loads are allocated as a result of the manner in which the three elements of vertical support post 55 are secured to downwardly-depending spigot 40. This securing means is best illustrated in FIG. 7 and in FIG. 8 which is a side view showing lift fitting 10 and downwardly-depending spigot 40 secured to vertical support post 55. Outwardly-facing surface 73 of spigot 40 is secured by welds along its vertical, longitudinal edges to outer support post 59. The upper end surface 75 of outer support post 59 is secured by a weld 77 on lower surface 24 of body 12 where it intersects outer end surface 14. Inner post 57 and stiffener post 61 are then positioned in alignment with downwardly-depending spigot 40 such that upper surface 79 of internal post 57 engages beveled surface 65 of downwardly-depending spigot 40 where weld 81 is positioned. Arms 81 and 83 of internal post 57 are then in intimate contact with outer post 59 through the entire longitudinal length which is proximately equal to the height of the container. Arms 81 and 83 are then secured to outer post 59 by means of longitudinal welds 85.

An optional securing point is located at the surface to surface contact of lower end 87 of downwardly-depending spigot 40 and the upper surface of stiffener post 61. This optional weld can be accomplished by cutting an aperture in interior post 57 at this location to effectuate the weld, and then effecting the closure of the aperture.

Lift fitting 10, having depending spigot 40, when secured to vertical support post 55 in the manner described, ensures the integrity of a cargo container of non-standardized length when lift fitting 10 is mounted inboard from the corners of such container by allocating the stress and load factors and disbursing said stress and load factors throughout vertical support post 55 as opposed to concentrating the stress and load factors at the contact point of a vertical support post with a standard lift fitting. This structure also avoids the internal bracing which decreases the capacity of the container.

Referring once again to FIGS. 1 and 2, there is illustrated with respect to lift fitting 10 an optional support positioned within chamber 26. This optional support comprises two triangular-shaped gussets 90 which can provide additional support for lift fitting 10 with interfering with the crane lifting mechanism inserted into chamber 26 by means of aperture 28. These internal gussets 90 within chamber 26 of lift fitting 10 are optional, but not required in accordance with the teachings of the invention.

While the invention has been described with reference to its preferred embodiment thereof, it will appreciated by those of ordinary skill in the art that various changes can be made in the apparatus without departing from the basic spirit and scope of the invention.

I claim:

1. A lift fitting casting for long body cargo containers where said lift fitting is positioned inboard from the corners of said container, said lift fitting casting permitting the lifting and positioning of said long body containers by existing, standardized cranes, said lift fitting casting comprising:

a body member defined by an upper surface, lower surface, inner end surface, outer end surface and parallel sidewalls, said body member having a chamber defined therein, said chamber in communication with said upper surface by means of an aperture communicating between said chamber and said upper surface, said body member having a depending spigot positioned on said lower surface proximate to said outer end wall, said spigot having an interior facing surface and an exterior facing surface, said interior facing surface of said spigot is stepped, said step for engagement with a vertical support, said exterior facing surface of said spigot is planar and recessed from said outer end surface of said body member;

means for securing said body member to horizontal supports of said cargo container;

means for securing said downwardly-depending spigot of said body member to said vertical support of said cargo container.

2. A lift fitting casting in accordance with claim 1 wherein said aperture communicating between said chamber and said upper surface is of a size sufficient for receipt of a lifting crane arm.

3. A lift fitting casting in accordance with claim 1 wherein said means for securing said body member to said horizontal supports of said cargo container comprises welding of said horizontal supports of said cargo container to said parallel sidewalls of said body member.

4. A lift fitting casting in accordance with claim 1 wherein said means for securing said downwardly-depending spigot to said vertical support member of said cargo container comprises welding said spigot to said vertical support of said cargo container.

5. A lift fitting casting in accordance with claim 1 wherein said vertical support comprises an internal post, an external post and a stiffener, said internal post in secured engagement with said step of said spigot, said external post in secured engagement with said exterior facing surface of said spigot, said stiffener in secured engagement with the lower end of said spigot.

6. A lift fitting casting in accordance with claim 1 wherein said chamber of said body member has positioned therein, reinforcing stiffeners positioned on the interior of said chamber, tangential to said outer end surface and said lower surface.

7. A cargo container for the shipment of material, said cargo container comprising a top wall, a parallel bottom wall, parallel sidewalls, and parallel end walls, said cargo container constructed of a frame of interconnecting horizontal support members and vertical support members, said cargo container having a means for cooperation with a lift crane for lifting and positioning said cargo container and maintaining the structural integrity of said container, said means comprising:

a plurality of lift fitting castings positioned about the periphery of said sidewalls of said cargo container, each of said lift fittings comprising a body member having an upper surface, lower surface, inner end surface, outer end surface, and parallel sidewall surfaces, said body member defining a chamber therein, said chamber in communication with said upper surface of said lift fitting by means of an aperture communicating said chamber with said upper surface, each of said lift fittings secured to said horizontal frame members of said cargo container, each of said lift fittings having a downwardly-depending spigot secured to a respective vertical support member of said frame of said container, wherein said downwardly-depending spigot of said lift fitting has an interior facing surface, said interior facing surface being stepped, said step for engagement with said vertical support member, and wherein said exterior facing surface of said downwardly-depending spigot of said lift fitting is planer and recessed from said outer end surface of said outer end surface of said body member.

8. A lift fitting casting in accordance with claim 7 wherein said vertical support member of said frame of said cargo container comprises an internal post, an external post and a stiffener, said internal post in secured engagement with said step of said spigot on said interior facing surface, said external post in secured engagement with said exterior facing surface of said spigot, said stiffener in secured engagement with said lower end of said spigot.

9. A plurality of lift fitting casting in accordance with claim 7 wherein said lift fitting castings are positioned about the periphery of said sidewalls of said cargo container for engagement with the standardized arms of said lift crane in said chambers of said body of said lift fitting for lifting and positioning said cargo container.

* * * * *